United States Patent [19]

Schmitz

[11] Patent Number: 4,827,677

[45] Date of Patent: May 9, 1989

[54] METHOD FOR GRINDING PLANE-PARALLEL CIRCULAR ANNULAR FACES ON DISK-SHAPED WORKPIECES

[75] Inventor: Heinz G. Schmitz, Wermelskirchen, Fed. Rep. of Germany

[73] Assignee: Supfina Maschinenfabrik Hentzen KG, Remsheid, Fed. Rep. of Germany

[21] Appl. No.: 131,565

[22] Filed: Dec. 11, 1987

[30] Foreign Application Priority Data

Dec. 11, 1986 [DE] Fed. Rep. of Germany ..... 3642304

[51] Int. Cl.[4] ..... B24B 1/00

[52] U.S. Cl. ..... 51/281 SF; 51/118; 51/165.77

[58] Field of Search ..... 51/281 SF, 281 R, 291, 51/326, 327, DIG. 3, 118, 117, 165.77, 165.75, 165.74

[56] References Cited

U.S. PATENT DOCUMENTS

| | | | |
|---|---|---|---|
| 3,721,046 | 3/1973 | Dunn | 51/118 |
| 4,019,288 | 4/1977 | Moritomo | 51/327 |
| 4,254,588 | 3/1981 | Onoda et al. | 51/291 |
| 4,524,547 | 6/1985 | Heaston et al. | 51/165.77 |
| 4,545,153 | 10/1985 | Miller | 51/118 |

FOREIGN PATENT DOCUMENTS

| | | | |
|---|---|---|---|
| 0375171 | 12/1973 | U.S.S.R. | 51/165.77 |

*Primary Examiner*—Frederick R. Schmidt
*Assistant Examiner*—Robert A. Rose
*Attorney, Agent, or Firm*—Jones, Tullar & Cooper

[57] ABSTRACT

A method is described for grinding plane-parallel circular annular faces on disk-shaped workpieces, in particular on brake disks of motor vehicle disk brakes, in which the workpieces have different grinding allowances, with respect to their set-point position, on their surfaces to be machined and are machined from both sides with side grinding wheels by the face grinding process, and in which the machining is effected in a plurality of phases at dissimilar feed speeds. The machining is effected in one method step at dissimilar feed speeds ($v_3$, $v_{3'}$), from the point ($P_2$, $P_{2'}$), of the first contact of the grinding wheel with the workpiece up to a point ($P_3$) on which on both sides of the workpiece, the same remaining grinding allowance ($s_0$) with respect to the set-point location of the faces to be machined, exists. The dissimilar feed speeds ($v_3$; $v_{3'}$) are matched to one another such that the point ($P_3$) at which the same remaining grinding allowance ($s_0$) exists on both sides is reached from both sides at the same instant ($t_3$).

3 Claims, 2 Drawing Sheets

METHOD FOR GRINDING PLANE-PARALLEL CIRCULAR ANNULAR FACES ON DISK-SHAPED WORKPIECES

FIELD OF THE INVENTION

The invention relates to a method for grinding plane-parallel circular annular faces on disk-shaped workpieces, in particular on brake disks of motor vehicle disk brakes, in which the workpieces have different grinding allowances, i.e., the amount of material to be ground varies at different parts of the workpiece, with respect to a completely ground set-point position. The workpieces are machined (ground) from preferably both sides with side grinding wheels, with the machining being done in a plurality of phases at varying feed speeds.

BACKGROUND OF THE INVENTION

A method of this kind is known from Examined German Patent Application DE-AS No. 21 22 798. Upon shutoff of the feed, the grinding wheels are locked in their respective positions and the workpiece is sparked out. By repeating these steps at the same or a reduced feed, the workpiece is ground down to a final dimension.

It is known to pre-grind the workpiece in such a way that identical dimensions are produced on both sides with respect to the set-point position of the faces. This pre-grinding (also described in the above-noted patent application, column 3, line 26) is effected at identical feed speeds but with different grinding allowances, and hence for different durations. Accordingly, it is possible that one wheel may still be grinding while the other is no longer grinding since the surface has already been ground down. This makes it impossible to prevent elastic deformation. The further machining is done incrementally by the stop-and-go method, each time with the sparking out taking place in between. However, this does not preclude recoiling of the elastically deformed surfaces produced in the first machining step, so that certain inaccuracies cannot be avoided. Furthermore, repeated stopping and sparking out is time-consuming and does not prevent dissimilar pressing forces from occurring on both sides over the short term at the resumption of the feed. These dissimilar forces can lead to elastic deformation of the workpiece, which once the pressing force is withdrawn can cause recoiling to the initial state and hence can cause inaccuracies.

SUMMARY OF THE INVENTION

It is an object of the present invention to improve the method of the above-described type in such a way that the accuracy of the plane parallelism is still further increased by providing that when grinding down dissimilarly thick grinding allowance on both sides of the workpiece, elastic deformations of the workpieces are avoided, particularly in the final phase. The method is also intended to be simpler and faster in its course.

This object is attained in that whenever the overall machining process has progressed far enough that both grinding wheels are in contact with the workpiece, the machining in the next phase is effected at dissimilar feed speeds, up to an intermediate ground position at which point the workpiece has an identically large remaining grinding allowance on both sides with respect to the set-point ground position of the face to be machined; these dissimilar feed speeds are adapted to one another such that the intermediate ground position is attained on both side at the same instant, and after that the removal of material is effected on both sides at an identical and increased feed speed.

Accordingly, up to a grinding allowance ($s_0$) that is identical on both sides of the workpiece, work is done with dissimilar feed speeds, which are adapted to one another in such a way that the intermediate ground position is reached from both sides at the same instant, this position or location having an equally large remaining grinding allowance on both sides of the workpiece. From there on, grinding is done on both sides continuously, with identical speeds, until the desired finished dimension is reached (set-point position). The process of "roughing", that is the grinding down of the majority of the grinding allowance that is to be ground down overall, does not take place until the dissimilar dimensions on both sides, as well as the errors in shape, have been eliminated, using grinding forces that are not excessively high. This absolutely assures that no elastic deformation of the workpiece due to dissimilar pressing forces of the grinding wheels can arise.

An exemplary embodiment of the invention will now be described in further detail, referring to the accompanying drawings.

DESCRIPTION OF THE PREFERRED EMBODIMENTS

Figure 1:
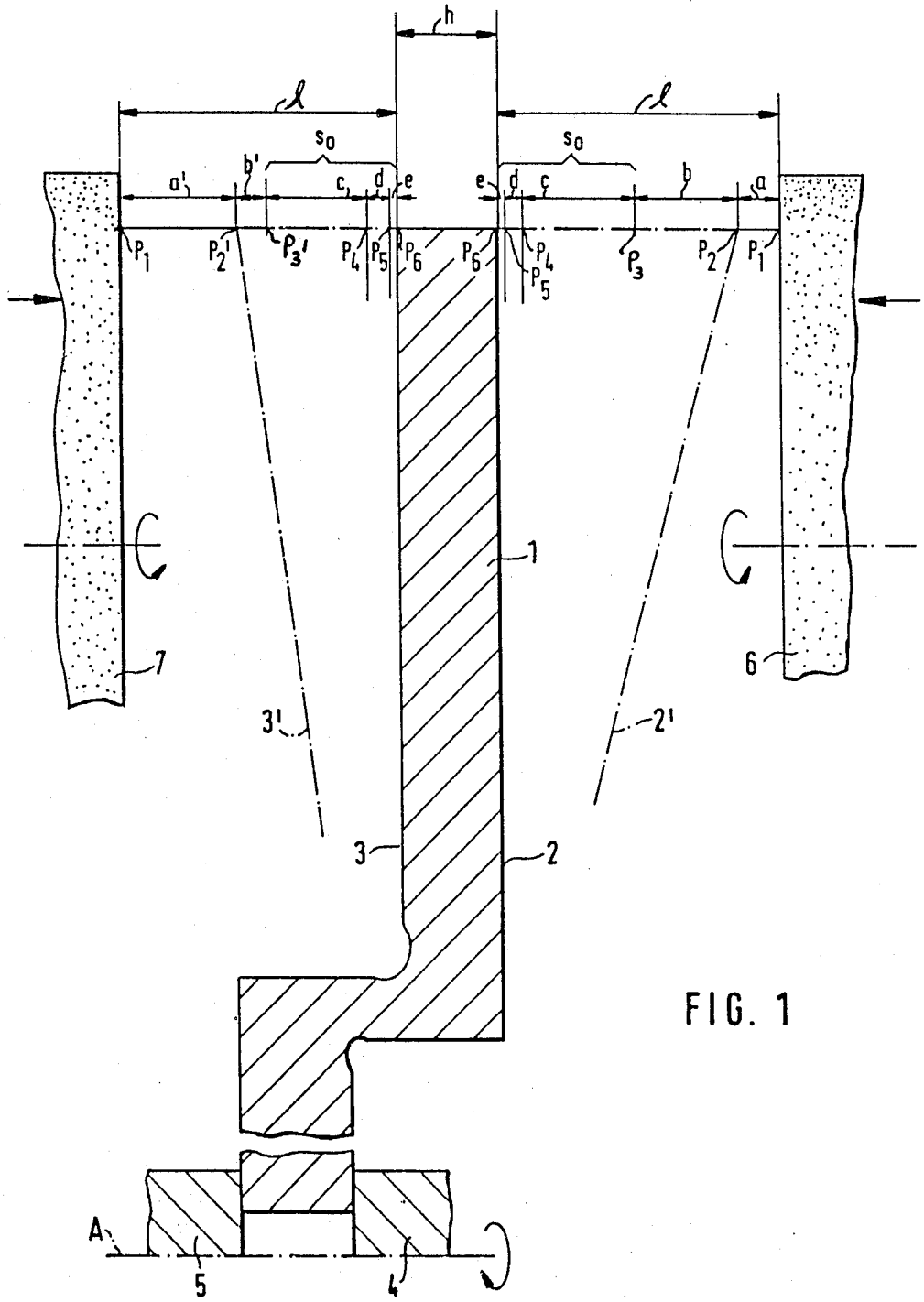
FIG. 1 is a schematic illustration of the machining of a brake disk.

FIG. 1 shows a brake disk 1, as an example of a workpiece. Its two side faces 2 and 3, extending spaced apart by the distance h from one another are to be machined such that to a great extent they are flat, exactly parallel to one another, and exactly at right angles to the axis of rotation A. The contour of the brake disk 1 prior to grinding is shown extremely exaggerated and marked 2' and 3', respectively. This protruding contour 2', 3' must be ground down to a set-point position of the side faces 2, 3 shown in solid lines. During grinding, no elastic deformation from dissimilar pressing of the grinding wheels should take place once the pressing force is withdrawn, that would cause recoiling toward the initial position and hence a lasting unevenness or inaccuracy in terms of the plane parallelism.

For machining, the brake disk 1 is fastened between clamping jaws 4 and 5 and rotated about the axis of rotation A. The side faces 2, 3 are machined with side grinding wheels 6, 7, which rotate and are fed in the direction of the arrows toward the side faces 2, 3 or their contours 2', 3'.

In the position shown in FIG. 1, the grinding wheels 6, 7 are located at the points $P_1$ in the feed direction. Beginning at these points $P_1$, length l is defined by both grinding wheels 6, 7 down to the finished dimension (that is, the set-point position of the side faces 2, 3 as shown in the drawing).

Figure 2:
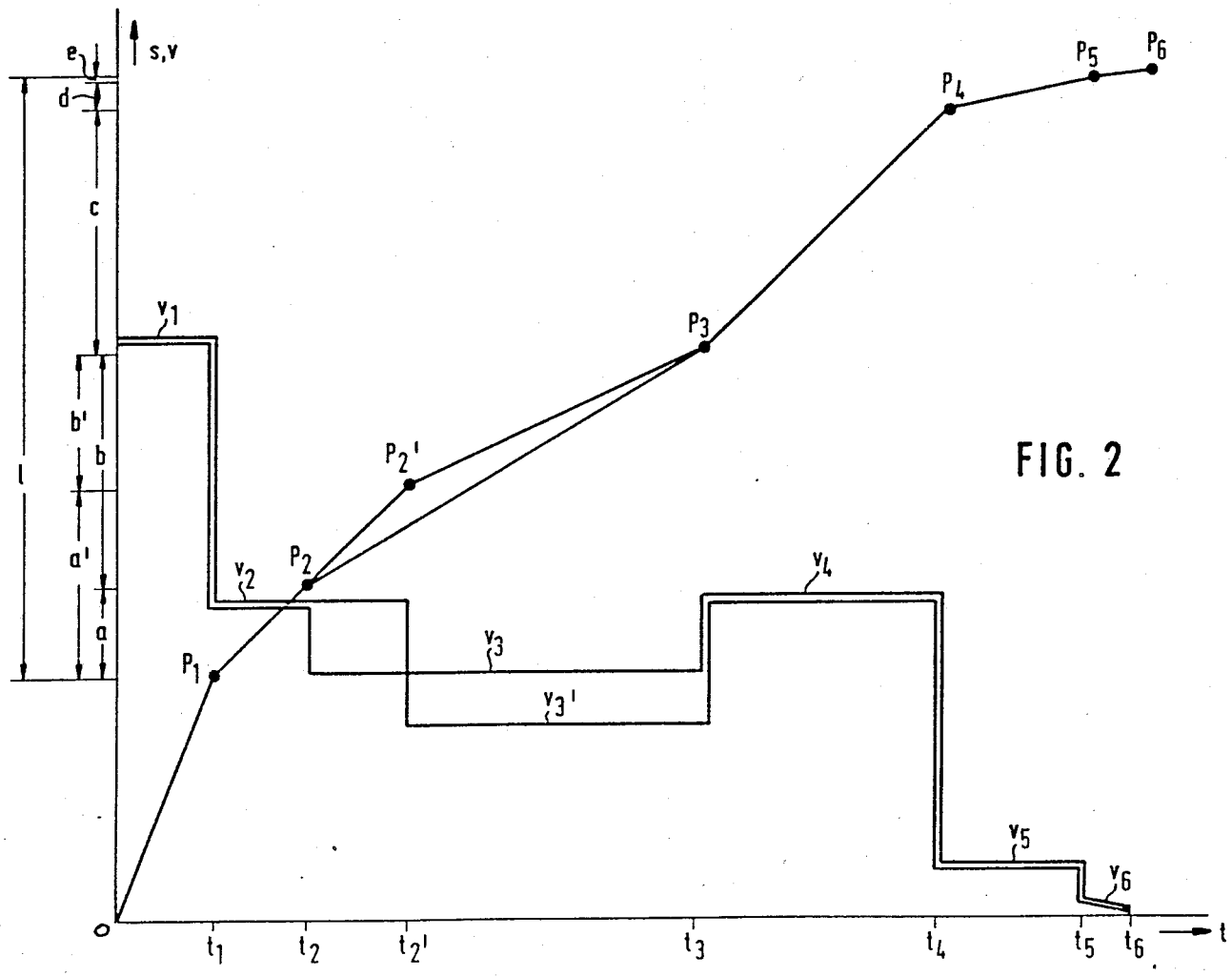
FIG. 2 is a travel or speed/time diagram for the machining process of FIG. 1.

In FIG. 2, the ordinate shows the travels of both grinding wheels 6, 7 in the feed direction and the speed v of both grinding wheels 6, 7 in the feed direction, as a function of time, which is recorded on the abscissa. The feed speeds of the two grinding wheels 6, 7 are marked as $v_1$, $v_2$, $v_3$ or $v_{3'}$, $v_4$, $v_5$ and $v_6$. The feed speeds for both grinding wheels 6, 7 are identical up to time $t_2$. From $t_3$ to the end of the machining at $t_6$, they are also identical; however, between $t_2$ and $t_3$ they are different, namely being $v_3$ and $v_{3'}$, respectively.

The line beginning at the origin (O) of the diagram in FIG. 2 shows the travel s as a function of time t. The travel from $P_1$ to $P_6$ is equivalent to the distance l, which is also shown in FIG. 1.

The grinding wheels 6, 7 initially move at the same speed $v_1$, from an initial position not shown in FIG. 1, into the initial position $P_1$ that they reach at time $t_1$. At $P_1$, contact is not allowed with contours 2', 3'. The travel to $P_1$ can therefore, be accomplished at high speed.

From $P_1$ on, feeding is done at the lesser speed $v_2$, for the same length of time from both sides until, at $P_2$ at time $t_2$, the first point-to-point contact of the grinding wheel 6 with the contour 2' takes place. A point-to-point contact of this kind can be dictated in the situation that the machined face is oblique, or in other words has a so-called plane eccentricity. However, it can also be caused by the situation in practice where the surface has small corrugations in the circumferential direction, that is, "hills" and "valleys". A point-to-point contact of this kind is ascertained simply by measuring the cosine $\phi$, that is, the phase angle between voltage and current in the drive motor of the grinding wheels 6, 7. The cosine $\phi$ is load-dependent and is an extraordinarily sensitive measure for the meeting of the grinding wheels 6, 7 with the workpiece 1.

The meeting of the grinding wheels 6, 7 with the contours 2', 3' takes place at the points $P_2$ and $P_{2'}$. The distance from $P_1$ to $P_2$ is a; the distance from $P_1$ on the left-hand side of FIG. 1 to $P_{2'}$is a'. The two distances, a and a' are different.

At the instant of contact of the grinding wheels 6, 7 with the contours 2' and 3', that is, at points $P_2$ and $P_{2'}$, the feed speed again changes. It is decreased as soon as the contact takes place, that is, at the times $t_2$ and $t_{2'}$. A change is effected in the feed speed, to $v_3$ or $v_{3'}$, a different speed for each of the two grinding wheels 6, 7. For the grinding wheel 6 that first meets the contour 2' at the time $t_2$ at point $P_2$, the speed is $v_3$. For the grinding wheel 7 that is the second to meet the contour 3', which takes place at the time $t_2$, at point $P_2$, the speed is $v_{3'}$. The machining now takes place on both sides over dissimilar distances, namely on the right-hand side in FIG. 1 from $P_2$ to $P_3$ over the distance b, and on the left-hand side of FIG. 1, from $P_2$, to $P_{3'}$ over the distance b'. The length of these distances b, b' is defined such that whenever the points $P_3$, $P_{3'}$ are reached from both sides, the remaining grinding allowance $s_0$ on both sides, that is, the amount that must be ground down until the final dimensions are attained, is of equal size. This is the case when in this phase the grinding allowances b and b' are defined such that $a'+b'=a+b$.

If b and b' are defined, then $v_3:v_{3'}=b:b'$, so that the remaining grinding allowance $s_0$ (points $P_3$, $P_{3'}$) is reached from both sides at the same time $t_3$.

Once the points $P_3$, $P_{3'}$ have been reached from both sides, and the remaining grinding allowance $s_0$ to be ground down to attain the finished dimensions (set-point position) of the side faces 2, 3 is equal on both sides, then from this point on it is assured that the final dimension will also finally be reached from both sides, with exactly identical feed speeds and therefore identical pressing forces from both sides, at precisely the same instant, namely at time $t_6$ and any electric deformation of the brake disk 1 during the machining can be prevented.

From $P_3$, $P_{3'}$ on, rough grinding is first done with full power and a maximum possible feed speed $v_4$, one which is further increased over $v_3$ or $v_{3'}$, and once the point $P_4$ is reached, after grinding down of the portion c of the grinding dimension, at the time $t_4$, a switchover is again made, specifically to the reduced finishing speed $v_5$, which is again the same for both grinding wheels 6, 7. At this speed, the portion d of the grinding dimension is ground down until point $P_5$ at time $t_5$. Finally, from $P_5$ to point $P_6$, the process known as sparking out takes place, over a distance e until time $t_6$.

What is claimed is:

1. A method for grinding two plane-parallel circular annular faces of disk-shaped workpieces, in particular brake disks for motor vehicle disk brakes, in which said two annular faces of the workpieces to be ground have unequal grinding allowances between an original unground position and their desired end position after grinding, and in which both faces of the workpiece are ground from both sides by grinding disks with different feed speeds, comprising the steps of:

advancing both grinding disks during a first phase to a position in which contact is established with the respective annular faces of the workpiece;

further advancing both grinding disks during a second phase at dissimilar feed speeds to intermediate positions at which the grinding allowances remaining are similar on both annular faces of the workpiece, the dissimilar feed speeds being determined such that said intermediate position of both annular faces of the workpiece is reached at the same time; and further advancing both grinding disks during a third phase at a similar feed speed, said similar feed speed being higher than said dissimilar feed speeds, such that as a result of said similar feed speed and the same grinding distance covered during said third phase, the desired end position on both sides of the workpiece are reached at the same instant.

2. The method as defined in claim 1, wherein the ratio of the different feed speeds in said second phase is equal to the ratio of the distances of the grinding disks between the contact positions and the intermediate positions.

3. The method as defined in claim 1, wherein each grinding disk is advanced by an associated drive motor, further comprising the step of:

determining the instant of first contact of the grinding disks with the still unground annular face of the workpiece by measuring the change in the phase angle of the current of said associated drive motor.

* * * * *